US008147627B2

(12) United States Patent
Redecker et al.

(10) Patent No.: US 8,147,627 B2
(45) Date of Patent: Apr. 3, 2012

(54) IGNITION MEANS FOR PROPELLANT POWDERS

(76) Inventors: Klaus Redecker, Nuremberg (DE); Ulrich Bley, Nuremberg (DE); Rainer Hagel, Eriangen (DE)

( * ) Notice: Subject to any disclaimer, the term of this patent is extended or adjusted under 35 U.S.C. 154(b) by 665 days.

(21) Appl. No.: 11/328,840

(22) Filed: Jan. 10, 2006

(65) Prior Publication Data

US 2007/0204941 A1 Sep. 6, 2007

Related U.S. Application Data

(63) Continuation of application No. 10/130,885, filed as application No. PCT/EP00/12169 on Dec. 4, 2000, now abandoned.

(30) Foreign Application Priority Data

Mar. 12, 2000 (DE) ..... 199 58 361

(51) Int. Cl.
*C06B 45/10* (2006.01)
*C06B 33/00* (2006.01)
*D03D 23/00* (2006.01)

(52) U.S. Cl. ..... 149/19.7; 149/19.8; 149/37; 149/108.6

(58) Field of Classification Search ..... 149/19.7, 149/19.8, 37, 108.6
See application file for complete search history.

(56) References Cited

U.S. PATENT DOCUMENTS 3,682,727 A * 8/1972 Heinzelmann ..... 149/19.2
4,956,029 A * 9/1990 Hagel et al. ..... 149/19.8
5,773,748 A * 6/1998 Makowiecki et al. ..... 102/205

* cited by examiner

*Primary Examiner* — Aileen B Felton
(74) *Attorney, Agent, or Firm* — Fulbright & Jaworski L.L.P.

(57) ABSTRACT

Ignition means for propellant powders include at least one oxidation means, at least one reduction means and at least one binder, and are free from primary explosives.

11 Claims, No Drawings

IGNITION MEANS FOR PROPELLANT POWDERS

This application is a continuation application of U.S. Ser. No: 10/130,885 filed Aug. 26, 2002 now abandoned, which is a §371 of PCT/EP00/12169 filed Dec. 4, 2000.

The present invention relates to an ignition means for propellant powders, as well as its use.

Cartridges filled with propellant powders are mainly used in the civil sector, in particular in setting bolt devices or for stunning cattle. The cartridges may be formed of metal or plastics material.

The propellant powder is normally ignited by a mechanically or electrically initiated reaction of an ignition charge consisting of at least one primary explosive material. A reliable ignition is thereby generally ensured.

The manufacture and the use of ignition charges containing primary explosive materials are permitted only under special conditions, however, due to safety requirements. In addition there are difficulties in their transportation, since they are classed as dangerous goods, as well as in their storage and handling, which require specially trained and skilled staff.

An object of the present invention was accordingly to provide an ignition means for propellant powders that does not have these disadvantages.

This object was achieved according to the invention by the features of the main claim. Preferred embodiments are defined in the subclaims.

The ignition means according to the invention is essentially concerned with a material for propellant powders that is free of primary explosive and that contains at least one oxidising agent, at least reducing agent and at least one binder.

The ignition means according to the invention generates, on combustion, particles that ignite the propellant powder.

By means of the present invention it is therefore possible for the first time reliably to ignite propellant powders without the use of primary explosives.

The ignition means according to the invention may be used for example for reliable ignition of propellant powders contained in cartridges that are used for example in bolt setting devices. A propellant powder derived from cellulose nitrate may for example be used. The propellant powder may however also consist of components that are used for example in propellant powders that generate low CO content reaction gases (for example so-called SINCO® propellant powders). Reference may be made in this connection to EP 0 809 616 A1. Such cartridges are described for example in DE 198 24 122 A1. The cartridges may be sealed by a foil, for example of aluminium.

The present invention provides the possibility of treating such sealing foils with the ignition means according to the invention so that, after appropriate initiation, they can act as an ignition means for the propellant powder.

For this purpose, the foil, for example an aluminium foil, is coated on the inside of the cartridge with the ignition means according to the invention, dried and then applied, for example by adhesion, to the cartridge filled with propellant powder. If the cartridge covering is now rapidly heated externally, for example by an electric discharge, the aluminium can react with the applied components with the formation of self-combusting particles that ignite the propellant powder.

The invention accordingly also provides coatings that can be applied to foils and that on combustion produce particles that can ignite the propellant powder, as well as the foils coated with the ignition means according to the invention.

The ignition means according to the invention may consist of the following components or mixtures of these components:

As binders there may for example be used:

Cellulose nitrate, cellulose as well as its derivatives such as cellulose acetate, cellulose butyrate, cellulose acetobutyrate, polyvinylbutyrals, polyvinylbutyrates, polynitropolyphenylene or polynitropolyphenyl ether, as well as their mixtures.

As oxidising agents there may for example be used:

Nitrates of alkali or alkaline earth elements or of ammonium, for example sodium nitrate, potassium nitrate or ammonium nitrate, perchlorates of alkali or alkaline earth elements or of ammonium, peroxides of alkaline earth elements or of zinc, for example zinc peroxide, or their mixtures.

As reducing agents there may for example be used:

Aluminium, titanium, titanium hydride, boron, boron hydride, zirconium, zirconium hydride, graphite or carbon black, as well as their mixtures.

As stabilisers there may for example be used components known to be effective in the thermal decomposition of nitric acid esters, for example urea derivatives such as Centralite or Akardite.

As combustion moderators there may for example be used ferrocene and its derivatives or oxidising agents that pass through various oxidation states.

As further additives there may for example be used energy-rich substances in order to improve the combustion, energy and thermal stability of the applied coating. Such additives are secondary explosives such as for example Octogen, Hexogen, etc..

In order to identify different formulations it may be advisable to add colourant components.

In order to improve the smell properties of the combustion gases it is convenient to add odoriferous substances.

In order to detect unauthorised use it may be expedient to add substances that can be subsequently traced to the manufacturer.

The amount of the individual components is governed substantially by the respective intended use. The oxidising agent may preferably be used in an amount of 5 to 50 wt. %, the reducing agent preferably in an amount of 5 to 50 wt. % and the binder preferably in an amount of 1 to 40 wt. %. It is particularly preferred to use the oxidising agent in an amount of 10 to 40 wt. %, the reducing agent in an amount of 10 to 40 wt. % and the binder in an amount of 5 to 20 wt. %. The addition of stabilisers, combustion moderators and other additives is also governed by the respective intended use. The nature and the amount can readily be determined.

The production of the ignition means according to the invention is carried out by methods known per se, for example by mixing the component and applying the latter by coating or also by silk-screen printing.

The following examples are intended to illustrate the invention in more detail without however restricting the latter.

EXAMPLES

The following table gives the composition of ignition means according to the invention that may be employed in the form of coatings.

The coatings may be prepared as follows:

The binder specified according to the invention is dissolved in a suitable solvent known per se, preferably methyl acetate, and the individual components are added while stirring. The amount of solvent is governed by the laboratory method and the required viscosity.

| Component | Example 1 | Example 2 | Example 3 |
|---|---|---|---|
| Cellulose nitrate | 20 wt. % | | 20 wt. % |
| Cellulose acetate | | 20 wt. % | |
| Zirconium | 40 wt. % | 30 wt. % | |
| Titanium | | | 40 wt. % |
| Potassium nitrate | 40 wt. % | | 30 wt. % |
| Zinc peroxide | | 50 wt. % | 10 wt. % |

The invention claimed is:

1. A primer for propellant charges comprising:

a primer comprising a foil coated on at least one side with a mixture, wherein the mixture comprises:

at least one oxidizer selected from the group consisting of an alkali metal nitrate, an alkaline earth nitrate, chosen from the nitrates of the alkali or alkaline earth elements or of ammonia, an alkali metal perchlorate, an peroxide or alkaline earth peroxide ammonium perchlorate, an alkaline earth peroxide and zinc peroxide, or a mixture thereof, a reducing agent is selected from the group consisting of aluminum, titanium, titanium hydride, boron, hydroboride, zirconium hydride, graphite and carbon black; and a binding agent selected from the group consisting of nitrocellulose and cellulose, wherein the primer is a free of primary explosives.

2. A primer according to claim 1, wherein the primer further comprises at least one of, a stabilizer, at a burn-off moderator or an additive to improve one of burn-off, energy or thermal stability.

3. A primer according to claim 1, wherein said stabilizer is a component proven in the thermal decomposition of nitric acid esters selected from the group consisting of a urea derivative, an oxidizing agent as a burn-off moderator which passes through various valency stages and ferrocene.

4. The primer according to claim 1, wherein the film comprises aluminum.

5. A primer for propellant charges comprising:

a primer comprising a foil coated on at least one side with a mixture comprising at least one oxidizer, at least one reducing agent and at least one binder, wherein the at least one oxidizer is selected from the group consisting of an alkali metal nitrate, an alkaline earth nitrate, chosen from the nitrates of the alkali or alkaline earth elements or of ammonia, an alkali metal perchlorate, an peroxide or alkaline earth peroxide ammonium perchlorate, an alkaline earth peroxide zinc peroxide or a mixture thereof, the reducing agent is selected from the group consisting of from aluminum, titanium, titanium hydride, boron, hydroboride, zirconium hydride, graphite or carbon black and a mixture thereof; and the binding agent comprises at least one member selected from the group consisting of cellulose acetate, a cellulose butyrate, a cellulose acetobutyrate, a polyvinyl butyral, a polyvinyl butyrate, a polynitropolyphenyl and a polynitropolyphenyl ether;

wherein the primer is a free of primary explosives.

6. The primer according to claim 1, wherein the binding agent is nitrocellulose.

7. The primer according to claim 5, wherein the binding agent is nitrocellulose.

8. The primer according to claim 1, wherein the binding agent is cellulose.

9. The primer according to claim 5, wherein the binding agent is cellulose.

10. The primer according to claim 3, further comprising a secondary explosive.

11. A primer for propellant charges comprising:

a primer comprising a foil coated on at least one side with a mixture, wherein the mixture comprises:

at least one oxidizer selected from the group consisting of an alkali metal nitrate, an alkaline earth nitrate, chosen from the nitrates of the alkali or alkaline earth elements or of ammonia, an alkali metal perchlorate, an peroxide or alkaline earth peroxide ammonium perchlorate, an alkaline earth peroxide and zinc peroxide, a reducing agent is selected from the group consisting of aluminum, titanium, titanium hydride, hydroboride, zirconium hydride, graphite and carbon black; and a binding agent selected from the group consisting of nitrocellulose and cellulose.

* * * * *